US007312756B2

(12) United States Patent
Tsai et al.

(10) Patent No.: US 7,312,756 B2
(45) Date of Patent: Dec. 25, 2007

(54) ANTENNA

(75) Inventors: Feng-Chi Eddie Tsai, Taipei (TW); Kuan-Hsueh Tseng, Taipei (TW)

(73) Assignee: Wistron NeWeb Corp., Taipei Hsien (TW)

( * ) Notice: Subject to any disclaimer, the term of this patent is extended or adjusted under 35 U.S.C. 154(b) by 97 days.

(21) Appl. No.: 11/328,888

(22) Filed: Jan. 9, 2006

(65) Prior Publication Data

US 2007/0159398 A1 Jul. 12, 2007

(51) Int. Cl.
*H01Q 1/24* (2006.01)
*H01Q 1/38* (2006.01)

(52) U.S. Cl. ..... 343/702; 343/826; 343/829; 455/575.7

(58) Field of Classification Search ..... 343/700 MS, 343/702, 846, 826, 829; 455/575.1
See application file for complete search history.

(56) References Cited

U.S. PATENT DOCUMENTS 4,800,392 A * 1/1989 Garay et al. ..... 343/700 MS
4,968,984 A * 11/1990 Katoh et al. ..... 343/713
6,903,690 B2 6/2005 Leclerc et al.
7,053,844 B2 * 5/2006 Gaucher et al. ..... 343/702

* cited by examiner

*Primary Examiner*—Michael C. Wimer
(74) *Attorney, Agent, or Firm*—Quintero Law Office

(57) ABSTRACT

An antenna comprises a ground element, a first transmission element, a feed element, a second transmission element and a third transmission element. The first transmission element is electrically connected to the ground element, wherein the first transmission element comprises at least one coupling portion, a first side and a second side. The feed element corresponds to the coupling portion. The second transmission element corresponds to the first side and is electrically connected to the ground element. The third transmission element corresponds to the second side and is electrically connected to the ground element. When a first wireless signal is transmitted, the feed element couples to the first transmission element to transmit the first wireless signal. When a second wireless signal is transmitted, the feed element couples to the first transmission element, and the second and third transmission elements couple to the first transmission element to transmit the second wireless signal.

30 Claims, 15 Drawing Sheets

100'

300

400

ANTENNA

BACKGROUND OF THE INVENTION

1. Field of the Invention

The invention relates to an antenna, and in particular to a wideband antenna.

2. Description of the Related Art

GSM 900 and DCS 1800 signals are widely utilized in cell phone communication to transmit audio and visual data. FIG. 1*a* shows a conventional flat antenna 1 to transmit GSM 900 and DCS 1800 signals, disposed in a cell phone, comprising a radiator 2 and a signal line 3. The signal line 3 is electrically connected to the radiator 2. With reference to FIG. 1*b*, when the flat antenna 1 transmits GSM 900 signal, a bandwidth thereof (bandwidth is defined as signals having voltage standing wave ratios lower than 4) is about 70 to 80 MHz, and when the flat antenna 1 transmits DCS 1800 signal, a bandwidth thereof is about 140 to 150 MHz.

Wireless communication, particularly long distance wireless transmission and wideband transmission, has become a necessary feature for portable electronic devices (for example, notebooks). Additionally, since communication standards for various areas are different, portable electronic devices are required to transmitting wireless signals under a variety of communication standards, such as AMPS (824~894 MHz) PCS(1850~1990 MHz) GSM(880~960 MHz) DCS(1710~1880 MHz) PDC(810~915 MHz) PHS(1895~1918 MHz) GPS(1575 MHz) and UMTS (1920~2170 MHz). The conventional flat antenna 1, however, has a narrow bandwidth, poor compatibility, and decreased transmission speed, such that it cannot satisfy wideband transmission requirements.

U.S. Pat. No. 6,903,690 discloses a conventional antenna. The conventional antenna, however, has a narrow bandwidth, such that it cannot satisfy wideband transmission requirements.

BRIEF SUMMARY OF THE INVENTION

A detailed description is given in the following embodiments with reference to the accompanying drawings.

An antenna comprises a ground element, a first transmission element, a feed element, a second transmission element and a third transmission element. The first transmission element is electrically connected to the ground element, wherein the first transmission element comprises at least one coupling portion, a first side and a second side. The feed element corresponds to the coupling portion. The second transmission element corresponds to the first side and is electrically connected to the ground element. The third transmission element corresponds to the second side and is electrically connected to the ground element, wherein when a first wireless signal is transmitted, the feed element couples to the first transmission element to transmit the first wireless signal, and when a second wireless signal is transmitted, the feed element couples to the first transmission element, and the second and third transmission elements couple to the first transmission element to transmit the second wireless signal.

The invention provides a wider band via a minor antenna. The invention is compatible with various communication standards, such as AMPS(824~894 MHz) PCS(1850~1990 MHz) GSM(880~960 MHz) DCS(1710~1880 MHz) PDC(810~915 MHz) PHS(1895~1918 MHz) GPS(1575 MHz) and UMTS(1920~2170 MHz), and provides increased transmission speed and decreased manufacturing cost.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
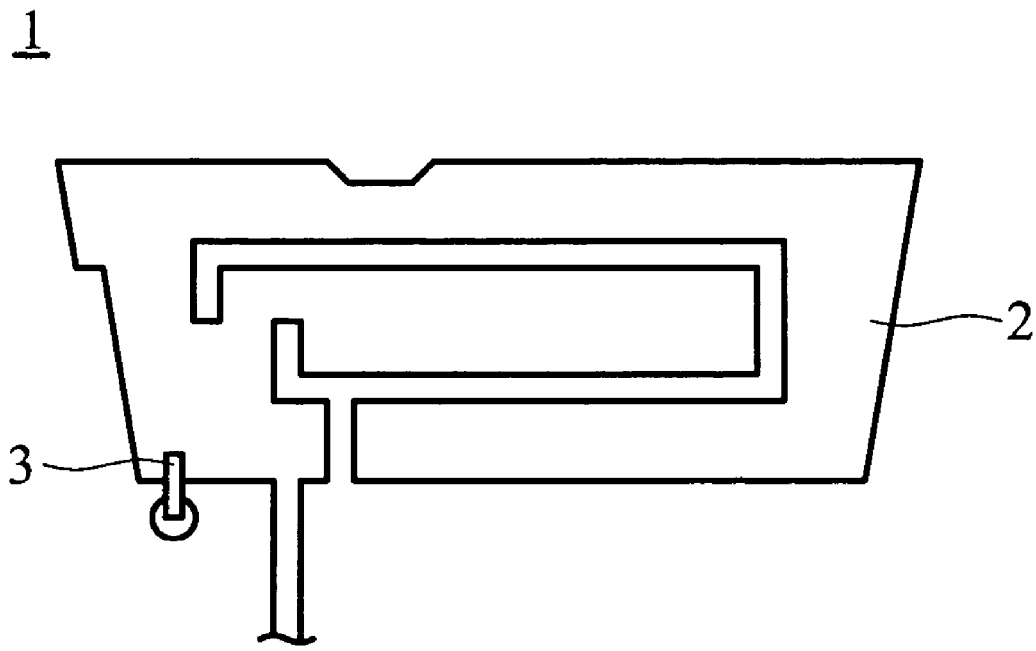
FIG. 1a (RELATED ART)
FIG. 1*a* shows a conventional flat antenna.
Figure 1B:
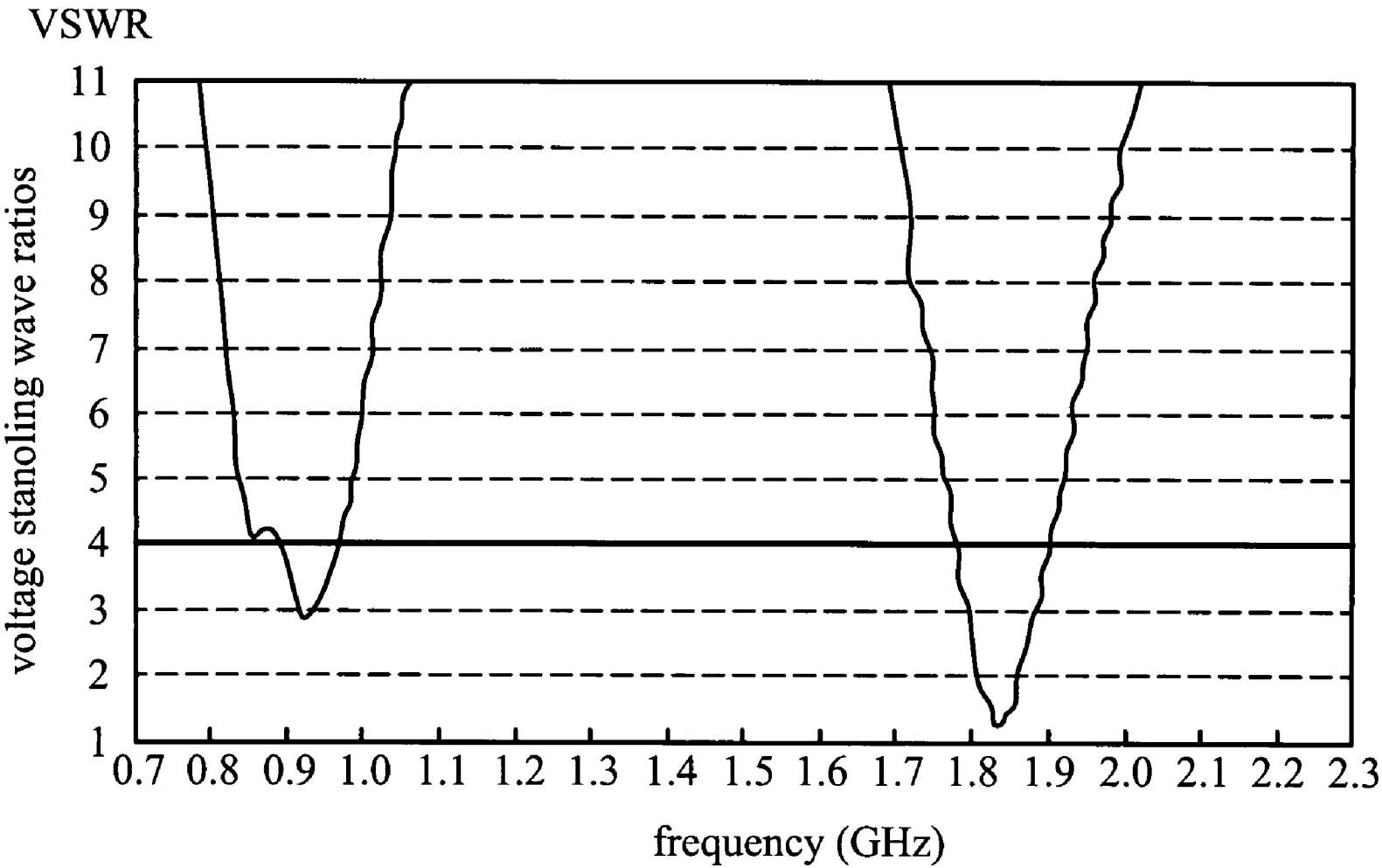
FIG. 1b (RELATED ART)
FIG. 1*b* shows signal transmission of the conventional flat antenna.
Figure 2A:
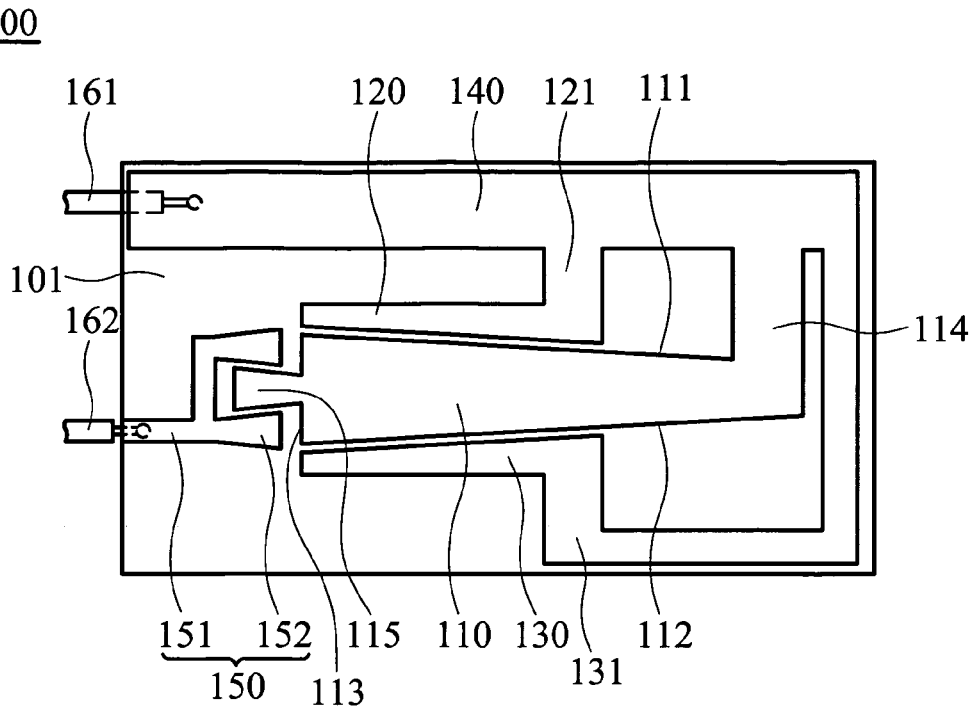
FIG. 2*a* shows a first embodiment of the invention.

FIG. 2*a* shows an antenna 100 of a first embodiment of the invention, a flat antenna. The antenna 100 comprises a first transmission element 110, a first conductive element 114, a second transmission element 120, a second conductive element 121, a third transmission element 130, a third conductive element 131, a ground element 140 and a feed element 150. The antenna 100 is a pattern formed on a circuit board 101, such as a flexible printed circuit board (FPC). The antenna 100 can also be a metal sheet independent of the circuit board. The ground element 140 is electrically connected to a ground line 161. The first transmission element 110 is connected to the first conductive element 114, and the first conductive element 114 is connected to the ground element 140. The first transmission element 110 is thus electrically connected to the ground element 140. The second transmission element 120 is connected to the second conductive element 121, and the second conductive element 121 is connected to the ground element 140. The second transmission element 120 is thus electrically connected to the ground element 140. The third transmission element 130 is connected to the third conductive element 131, and the third conductive element 131 is connected to the ground element 140. The third transmission element 130 is thus electrically connected to the ground element 140. The first transmission element 110 comprises a first side 111, a second side 112, a third side 113 and a coupling portion 115. The coupling portion 115 is a protrusion formed on the third side 113. The third side 113 is located between the first side 111 and the second side 112. The first side 111 is opposite to the second side 112. The first side 111 and the second side 112 are asymptotes, and the first side 111 and the second side 112 extend near each other from a first end to a second end of the first transmission element 110. The feed element 150 comprises a conductor 151 and a feed portion 152. The conductor 151 is connected to the feed portion 152 and electrically connected to a signal line 162. The feed portion 152 is U-shaped and surrounds the coupling portion 115.

Figure 2B:
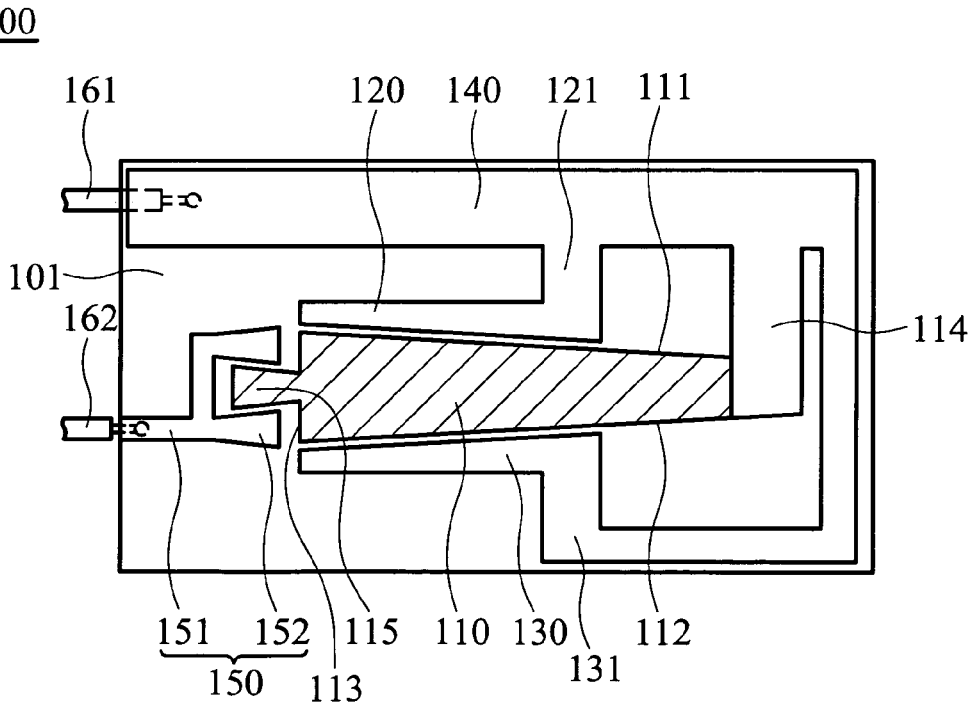
FIG. 2*b* shows the first embodiment transmitting a first wireless signal.
Figure 2C:
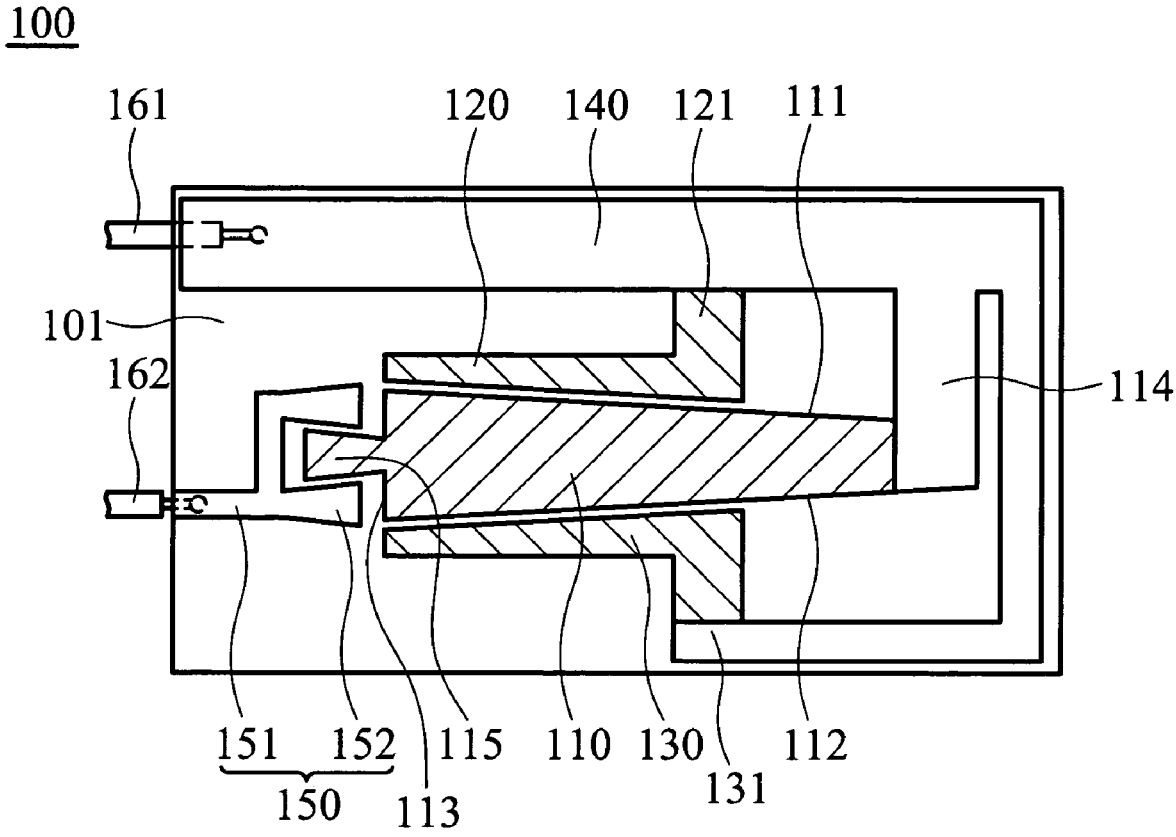
FIG. 2*c* shows the first embodiment transmitting a second wireless signal.
Figure 2D:
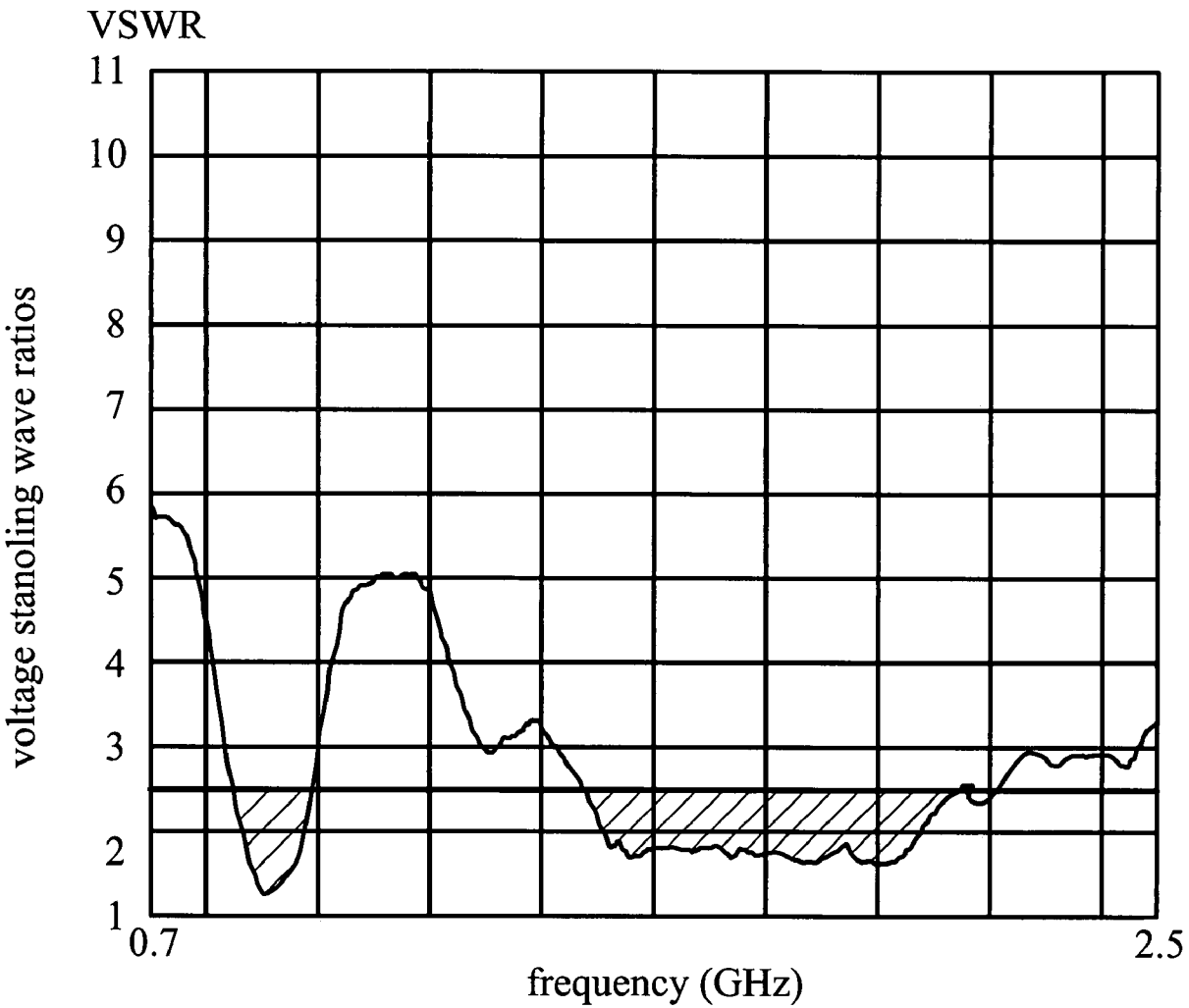
FIG. 2*d* shows signal transmission the antenna of the invention.

The antenna 100 is a monopole antenna, which transmits a first wireless signal and a second wireless signal via coupling. When the first wireless signal is transmitted, with reference to FIG. 2*b*, the feed portion 152 couples to the coupling portion 115 to transmit the first wireless signal via the first transmission element 110. With reference to FIG. 2*d*, bandwidth of the first wireless signal (bandwidth is defined as signals having voltage standing wave ratios lower than 2.5, wherein the definition here is stricter than the definition in the description of the related art ) is about 865 to 1025 MHz. With reference to FIG. 2*c*, when a second wireless signal is transmitted, the feed portion 152 couples to the coupling portion 115, and the second transmission element 120 and the third transmission element 130 couple to the first transmission element 110 to transmit the second wireless signal. With reference to FIG. 2*d*, a bandwidth of the second wireless signal (bandwidth is defined as signals having voltage standing wave ratios lower than 2.5) is about 1410 to 2200 MHz.

The invention provides a wider band via a minor antenna. The invention is compatible with various communication standards, such as AMPS(824~894 MHz) PCS(1850~1990 MHz) GSM(880~960 MHz) DCS(1710~1880 MHz) PDC(810~915 MHz) PHS(1895~1918 MHz) GPS(1575 MHz) and UMTS(1920~2170 MHz), and provides increased transmission speed and decreased manufacturing cost.

Figure 2E:
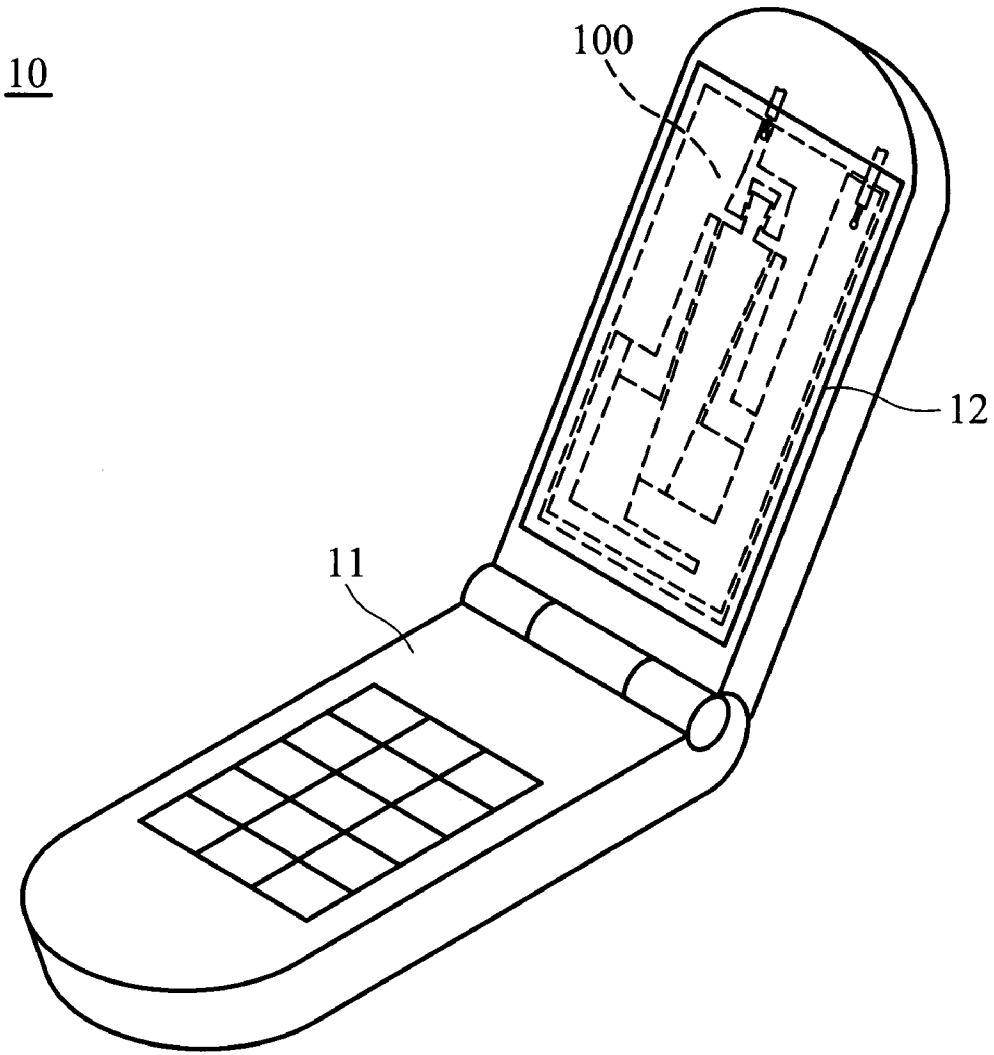
FIG. 2*e* shows the antenna of the invention disposed in a cell phone.

As shown in FIG. 2*e*, the antenna 100 of the invention can be disposed in a housing 11 of a portable electronic device (cell phone) 10 to transmit wireless signals. The housing 11 comprises a display portion 12, and the antenna 100 is disposed on a side of the display portion 12.

Figure 3A:
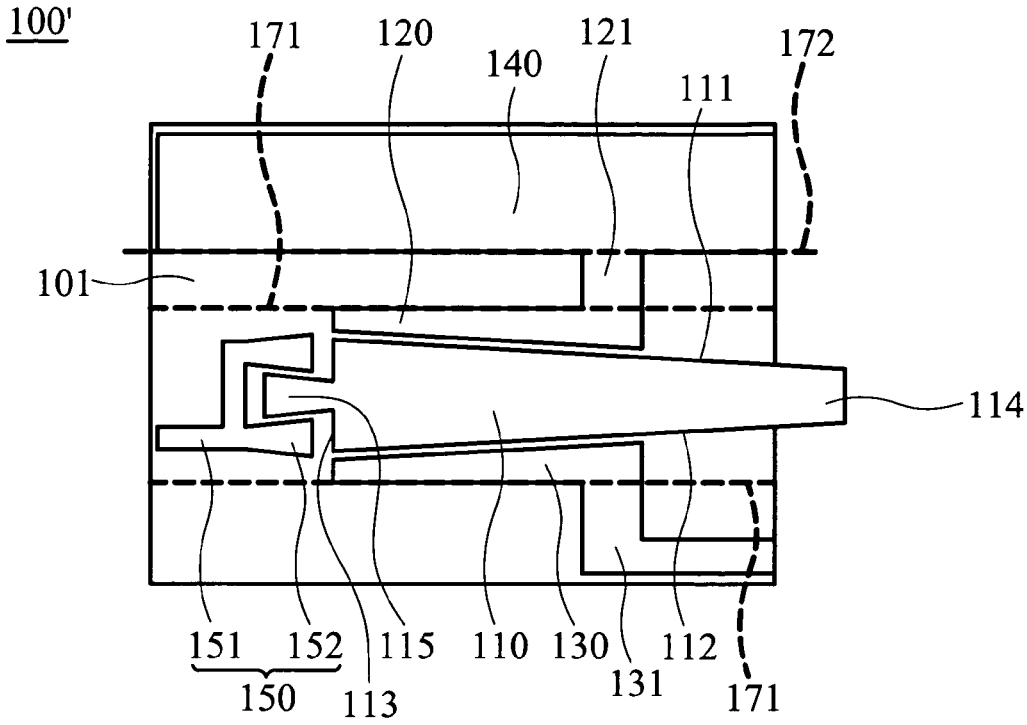
FIG. 3*a* shows a modified form of the first embodiment of the invention.
Figure 3B:
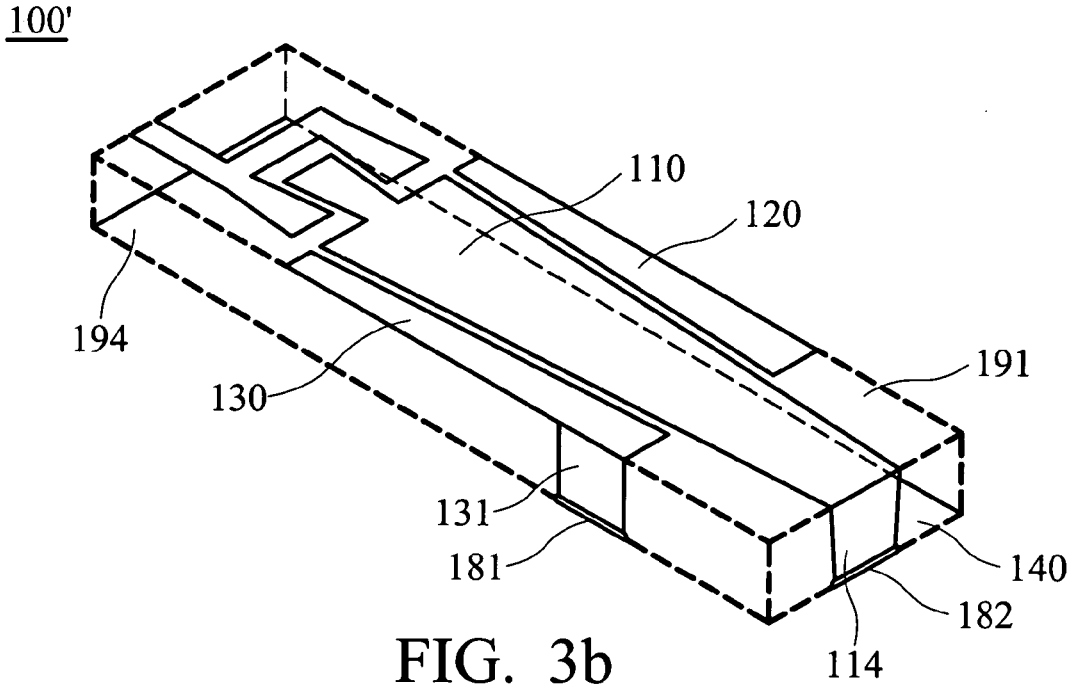
FIG. 3*b* shows a collapsed form of the embodiment in FIG. 3*a;*

FIG. 3*a* shows an antenna 100' of a modified form of the first embodiment, wherein the antenna 100' is collapsed along fold lines 171 and the fold line 172 to form a 3D structure. With reference to FIG. 3*b*, the first transmission element 110, the second transmission element 120 and the third transmission element 130 are located on a first plane 191, the ground element 140 is located on a fourth plane 194, and the first plane 191 is parallel to the fourth plane 194. The third conductive element 131 is electrically connected to the ground element 140 via welding point 181, and the first conductive element 114 is electrically connected to the ground element 140 via welding point 182.

Figure 3C:
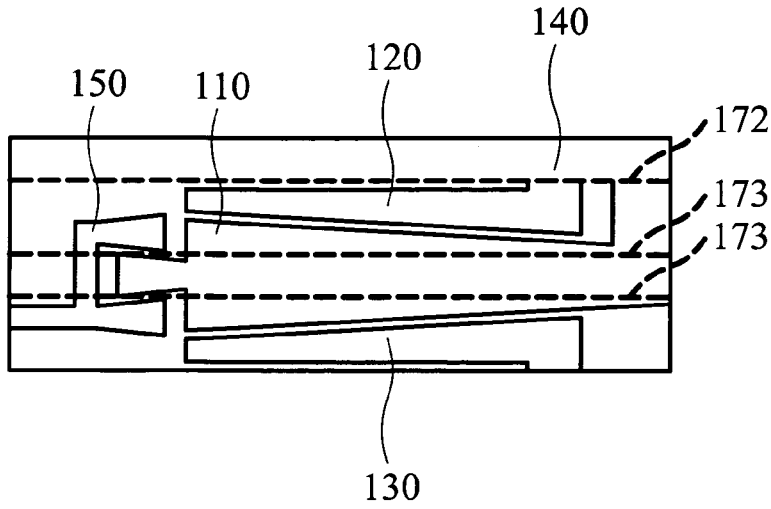
FIG. 3*c* shows another modified form of the first embodiment of the invention.

The location of the fold lines can be changed. As shown in FIG. 3*c*, the fold lines 173 are located on the first transmission element 110, such that, with reference to FIG. 3*d*, after the antenna 100' is collapsed, the first transmission element 110 is located on the first plane 191, the second transmission element 120 is on a second plane 192, the third transmission element 130 is on a third plane 193, and the ground element 140 is on the fourth plane 194. The second plane 192 is parallel to the third plane 193, and the first plane 191 is perpendicular to the second plane 192 and the third plane 193.

Figure 3D:
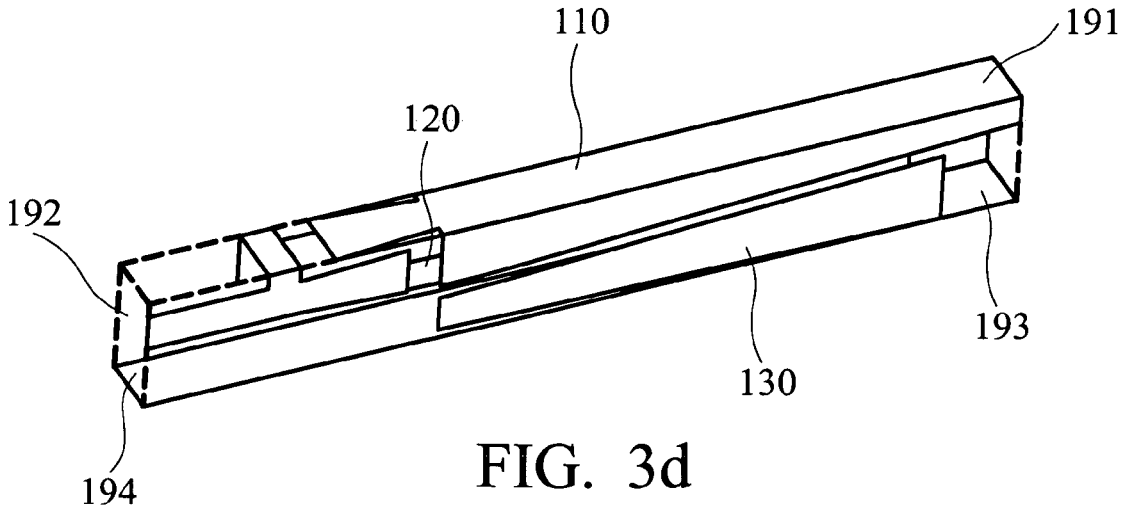
FIG. 3*d* shows a collapsed form of the embodiment in FIG. 3*c;*

With the modified forms shown in FIGS. 3*b* and 3*d*, the dimension and shape of the antenna can be changed for improved disposability in the portable electronic device.

Figure 3E:
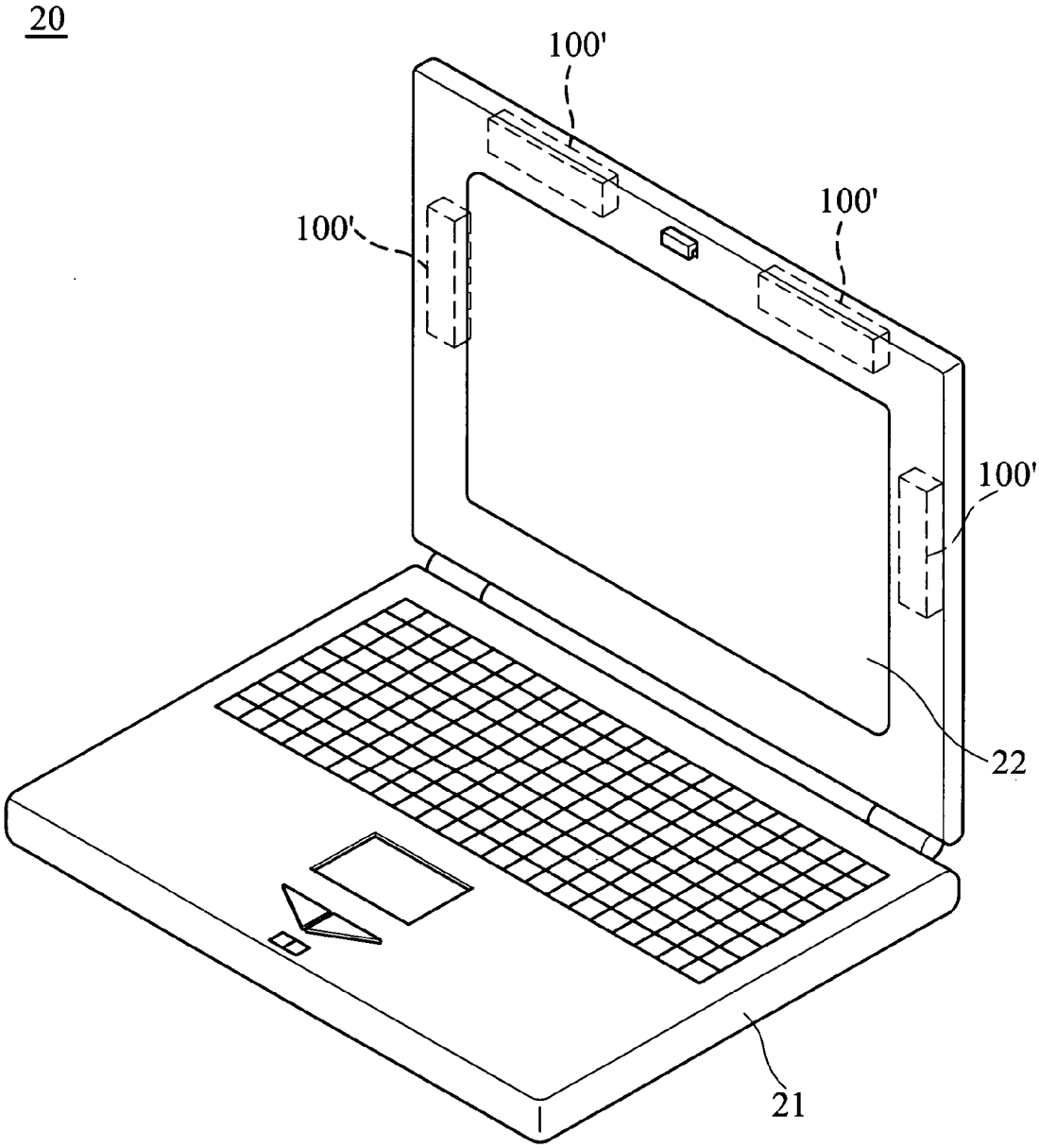
FIG. 3*e* shows the antenna of the invention disposed in a notebook.

As shown in FIG. 3*e*, a plurality of antennas 100' of the invention are disposed in a housing 21 of a portable electronic device (notebook) 20 to transmit wireless signals. The disposition directions of the antennas 100' are different (for example, perpendicular to each other) to improve transmission in different phases. The housing 21 receives a display device 22, and the antennas 100' are disposed between the display device 22 and the housing 21.

Figure 4:
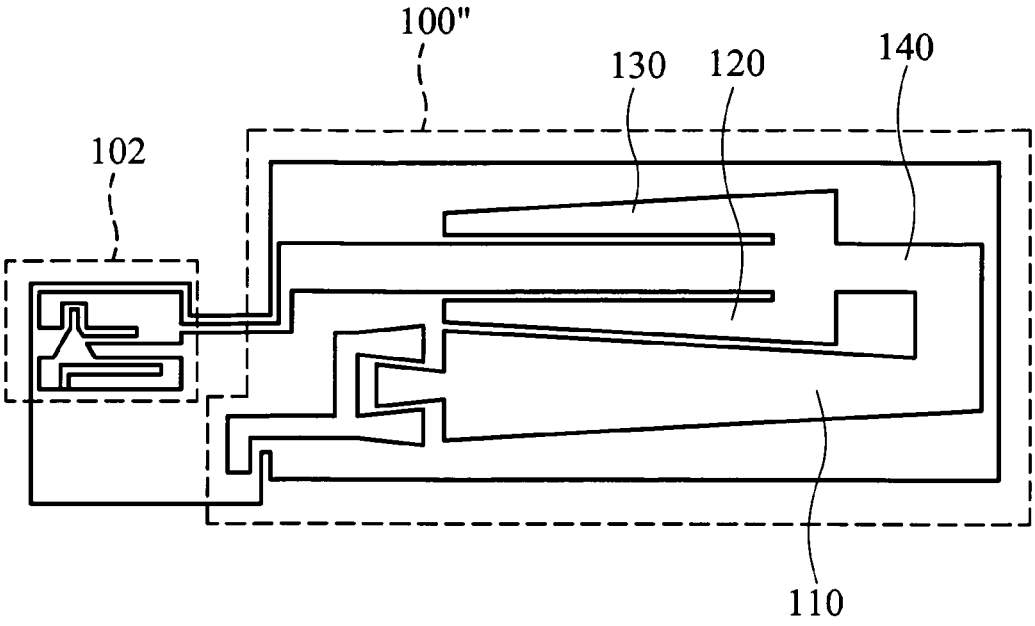
FIG. 4 shows another modified form of the first embodiment of the invention.

FIG. 4 shows an antenna 100" of another modified form of the first embodiment, wherein the second transmission element 120 and the third transmission element 130 are connected to two sides of the ground element 140. After the antenna 100" is collapsed, the second transmission element 120 and the third transmission element 130 corresponds to the first and second sides of the first transmission element 110. In the modified form of FIG. 4, the third conductive element 131 is electrically connected to the ground element 140 without welding point or other conductive sheet. The antenna 100" is further connected with a sub-antenna structure 102 to improve transmission thereof, wherein the sub-antenna structure 102 transmits a WLAN (wireless local area network) signal.

Second to eighth embodiments of the invention are disclosed in the following, wherein the ground element is replaced by a ground label to simplify the description.

Figure 5:
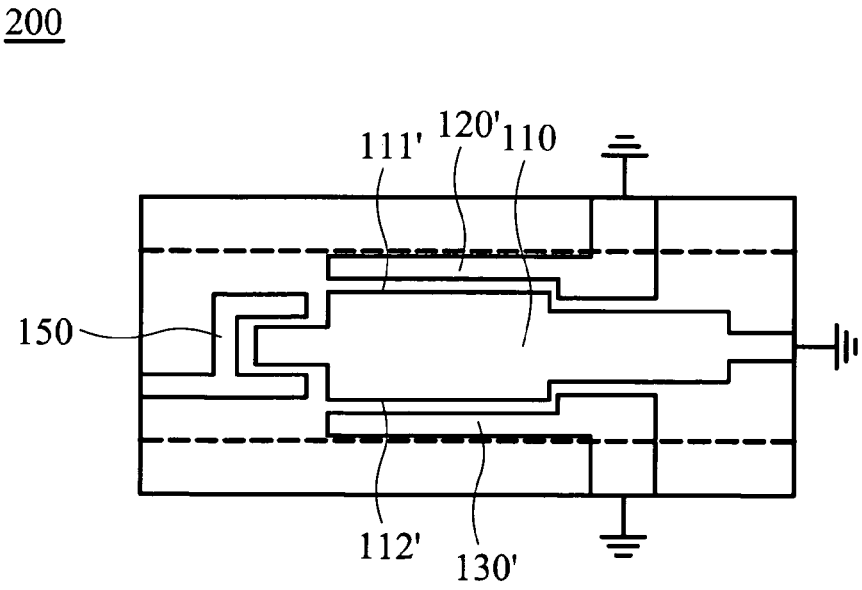
FIG. 5 shows a second embodiment of the invention.

FIG. 5 shows an antenna 200 of the second embodiment of the invention, wherein the first side 111' and the second side 112' are symmetrical stepped structures. The second transmission element 120' comprises a stepped portion corresponding to the first side 111', and the third transmission element 130' comprises a stepped portion corresponding to the second side 112'.

Figure 6:
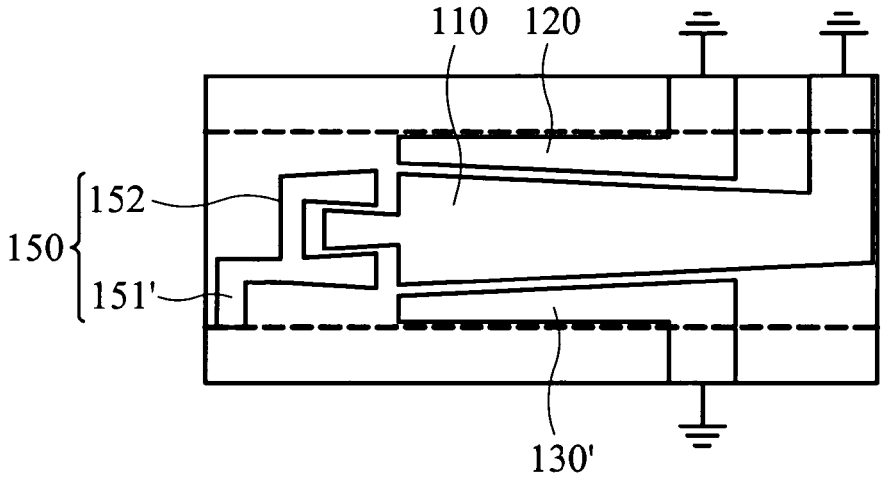
FIG. 6 shows a third embodiment of the invention.

FIG. 6 shows an antenna 300 of the third embodiment of the invention, wherein the conductor 151' is angled.

Figure 7:
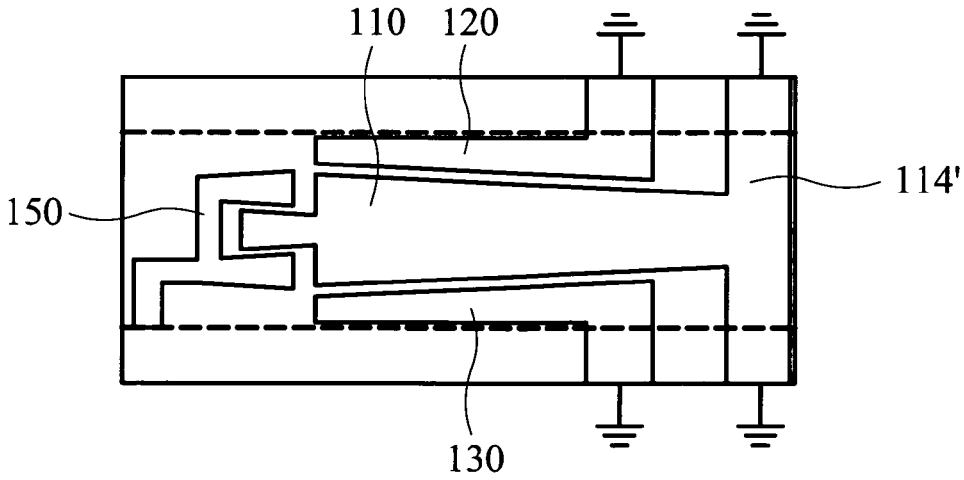
FIG. 7 shows a fourth embodiment of the invention.

FIG. 7 shows an antenna 400 of the fourth embodiment of the invention, wherein the first conductive element 114' is oblong, the first transmission element 110 is connected to the first conductive element 114', and the first conductive element 114' is electrically connected to the ground element via two ends thereof.

The antenna 400 has a more symmetrical antenna structure, and provides improved transmission.

Figure 8A:
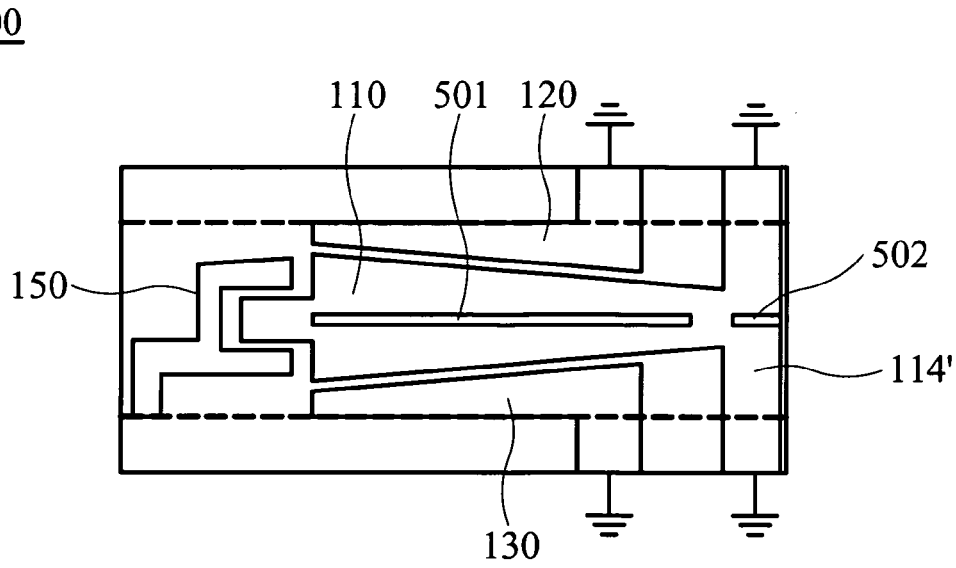
FIG. 8*a* shows a fifth embodiment of the invention.

FIG. 8*a* shows an antenna 500 of the fifth embodiment of the invention, wherein an opening 501 is formed on the first transmission element 110, and a notch 502 is formed on the first conductive element 114'.

Figure 8B:
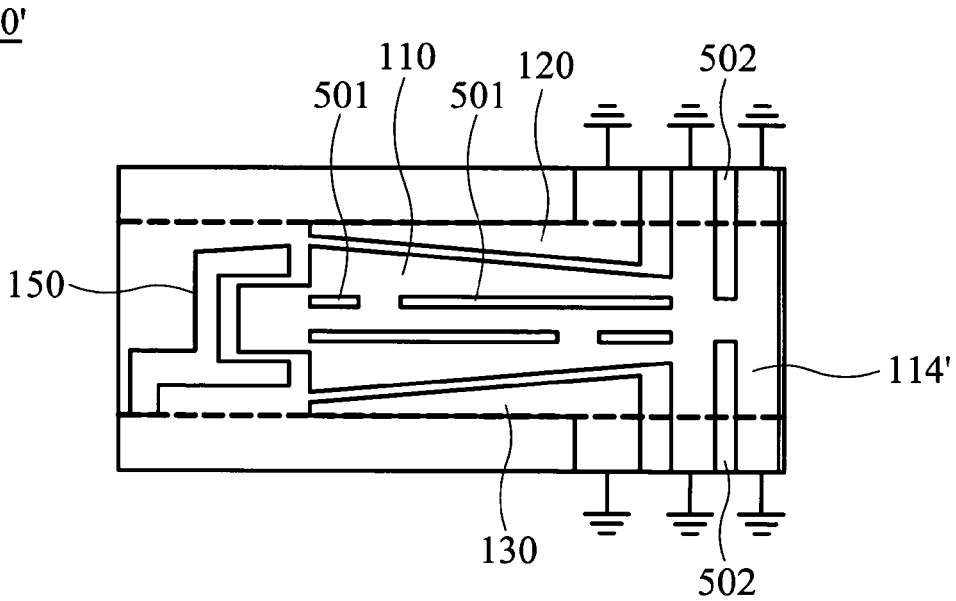
FIG. 8*b* shows a modified form of the fifth embodiment of the invention.

FIG. 8*b* shows an antenna 500' of a modified form of the fifth embodiment of the invention, wherein a plurality of openings 501 is formed on the first transmission element 110, and a plurality of notches 502 is formed on the first conductive element 114'. The location, shape and size of the openings 501 and the notches 502 can be modified.

Figure 9:
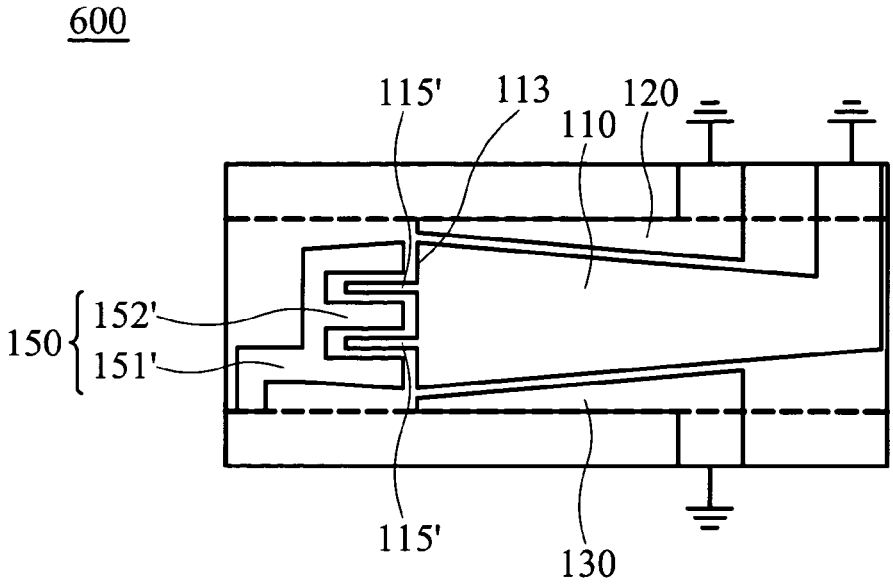
FIG. 9 shows a sixth embodiment of the invention.

FIG. 9 shows an antenna 600 of the sixth embodiment of the invention, wherein the first transmission portion 110 comprises a plurality of coupling portions 115' formed on the third side 113, the feed portion 152' comprises a plurality of coupling notches, and the coupling portions 115' are located in the coupling notches.

Figure 10:
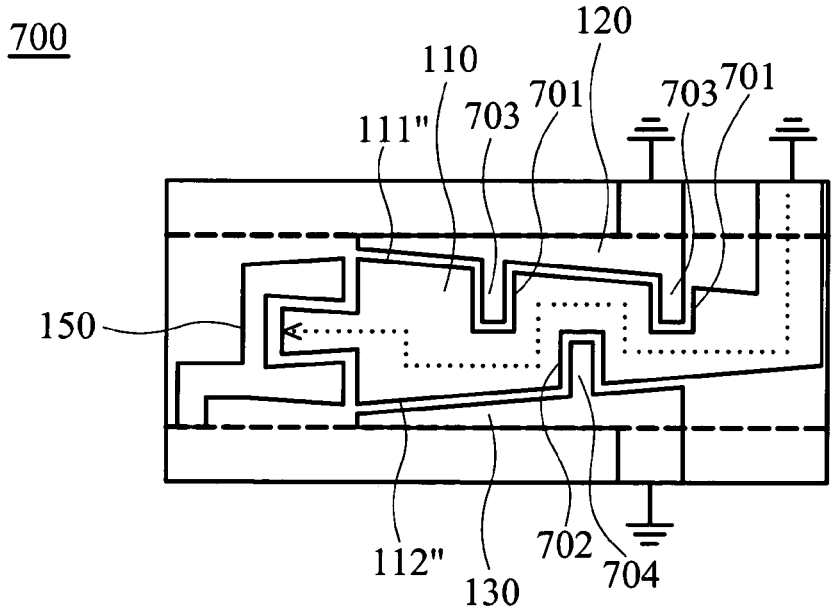
FIG. 10 shows a seven embodiment of the invention.

FIG. 10 shows an antenna 700 of the seventh embodiment of the invention, wherein the first transmission element 110 comprises two first recesses 701 disposed on the first side 111", and a second recess 702 disposed on the second side 112". The second transmission element 120 comprises first protrusions 703 inserted into the first recesses 701. The third transmission element 130 comprises a second protrusion 704 inserted into the second recess 702.

The antenna 700 increases signal transmission path via the first recesses 701 and the second recess 702, and the dimension thereof is further reduced.

Figure 11A:
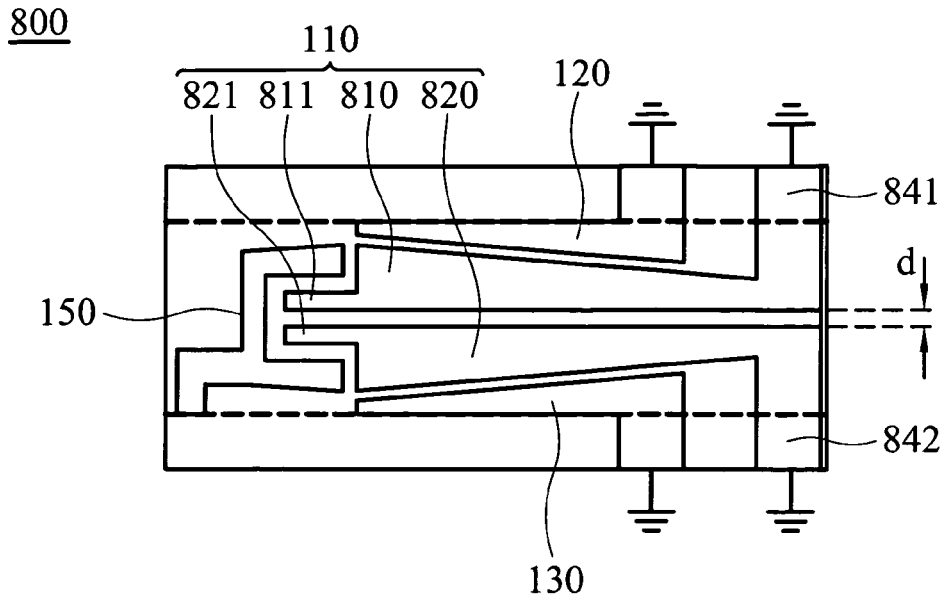
FIG. 11*a* shows an eighth embodiment of the invention.

FIG. 11*a* shows an antenna 800 of the eighth embodiment of the invention, wherein the first transmission element 110 further comprises a first portion 810 and a second portion 820. The first portion 810 is symmetrical to the second portion 820. A gap d is formed between the first portion 810 and the second portion 820. The coupling portion comprises a first section 811 and a second section 821, the first section 811 is connected to the first portion 810, and the second section 821 is connected to the second portion 820. The first portion 810 is disconnected from the second portion 820. The first portion 810 is grounded via a first conductive portion 841, and the second portion 820 is grounded via a second conductive portion 842.

Figure 11B:
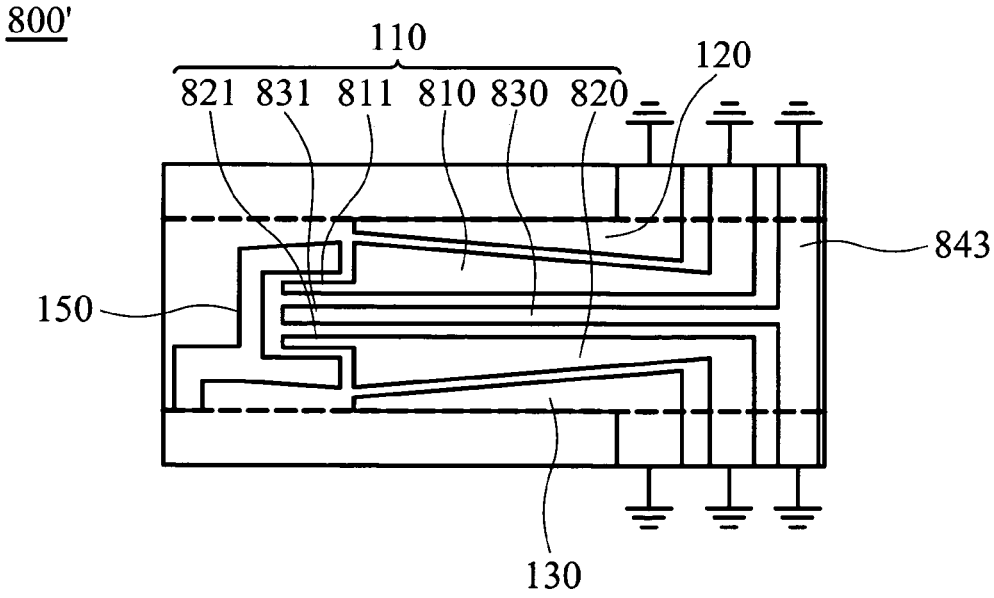
FIG. 11*b* shows a modified form of the eighth embodiment of the invention.

FIG. 11*b* shows an antenna 800' of a modified form of the eighth embodiment of the invention, which further comprises a third portion 830 and a third section 831. The third portion 830 is located between the first portion 810 and the second portion 820. The third section 831 is located between the first section 811 and the second section 821. The third portion 830 is disconnected from the first portion 810 and the second portion 820. The third portion 830 is grounded via the third conductive portion 843.

Figure 12:
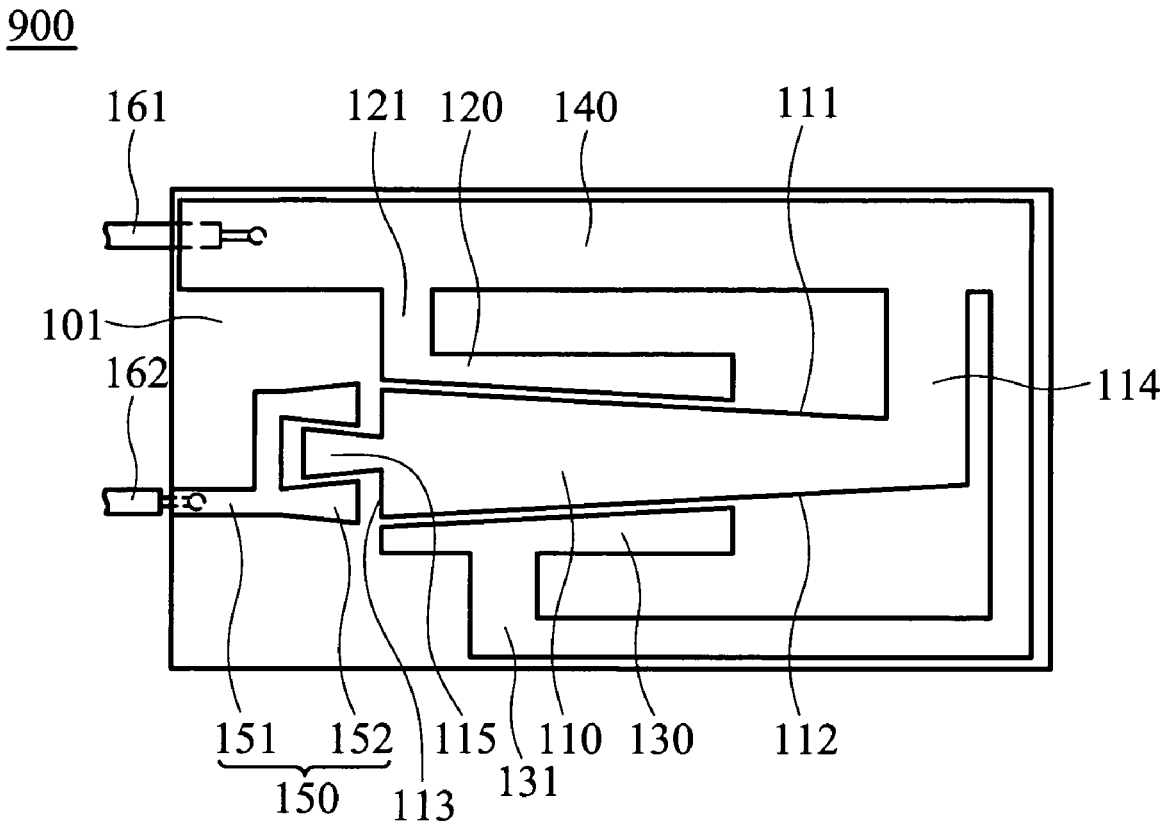
FIG. 12 shows a ninth embodiment of the invention.

FIG. 12 shows an antenna 900 of the ninth embodiment of the invention, wherein the second conductive element 121 is connected to an end of the second transmission element 120 near the feed element 150, and the third conductive element 131 is connected to a middle portion of the third transmission element 130.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a ground element;

a first transmission element having a at least one coupling portion, a first side and a second side and electrically connected to the ground element;

a feed element, corresponding to the coupling portion, wherein the feed element is separated from the coupling portion;

a second transmission element, corresponding to the first side and electrically connected to the ground element; and a third transmission element, corresponding to the second side and electrically connected to the ground element, wherein when transmitting a first wireless signal, the feed element electrically couples to the first transmission element to transmit the first wireless signal, and when transmitting a second wireless signal, the feed element electrically couples to the first transmission element, and the second transmission element and the third transmission element couple to the first transmission element to transmit the second wireless signal.

2. The antenna as claimed in claim 1, wherein the first transmission element comprises a third side, and the coupling portion is disposed on the third side.

3. The antenna as claimed in claim 2, wherein the coupling portion is a protrusion formed on the third side.

4. The antenna as claimed in claim 3, wherein the feed element comprises a feed portion, and the feed portion is U-shaped, corresponding to the coupling portion.

5. The antenna as claimed in claim 4, wherein the feed portion surrounds a part of the coupling portion.

6. The antenna as claimed in claim 3, wherein the first transmission portion comprises a plurality of coupling portions, the feed element comprises a plurality of coupling notches, and the coupling portions are located in the coupling notches.

7. The antenna as claimed in claim 1, wherein the first side is opposite to the second side, and the first side and the second side extend near each other from a first end to a second end of the first transmission element.

8. The antenna as claimed in claim 7, wherein the first side and the second side are stepped structures.

9. The antenna as claimed in claim 8, wherein the second transmission element comprises a stepped portion corresponding to the first side.

10. The antenna as claimed in claim 8, wherein the third transmission element comprises a stepped portion corresponding to the second side.

11. The antenna as claimed in claim 1, wherein the first transmission element comprises a first recess disposed on the first side, and the second transmission element comprises a first protrusion inserted into the first recess.

12. The antenna as claimed in claim 11, wherein the first transmission element comprises a second recess disposed on the second side, and the third transmission element comprises a second protrusion inserted into the second recess.

13. The antenna as claimed in claim 1, further comprising a first conductive element connected between the first transmission element and the ground element.

14. The antenna as claimed in claim 1, wherein the first conductive element is oblong, the first transmission element is connected to the first conductive element, and the first conductive element is electrically connected to the ground element via two ends thereof.

15. The antenna as claimed in claim 1, wherein the first transmission element comprises an opening formed thereon.

16. The antenna as claimed in claim 1, wherein the first transmission element further comprises a first portion and a second portion, a gap is formed between the first portion and the second portion, the coupling portion comprises a first section and a second section, the first section is connected to the first portion, and the second section is connected to the second portion.

17. The antenna as claimed in claim 16, wherein the first portion comprises a first conductive portion, the second portion comprises a second conductive portion, the first portion is electrically connected to the ground element via the first conductive portion, and the second portion is electrically connected to the ground element via the second conductive portion.

18. The antenna as claimed in claim 17, wherein the first transmission element further comprises a third portion, a third section and a third conductive portion, the third portion is disposed between the first portion and the second portion, the third section is disposed between the first section and the second section, and the third portion is electrically connected to the ground element via the third conductive portion.

19. The antenna as claimed in claim 1, wherein the first transmission portion, the second transmission portion and the third transmission portion are located on a first plane.

20. The antenna as claimed in claim 1, wherein the coupling portion is located on a first plane, the second transmission element is located on a second plane, the third transmission element is located on a third plane with the second plane parallel thereto, and the first plane intersecting the second plane and the third plane.

21. The antenna as claimed in claim 20, wherein the ground element is located on a fourth plane separate from the first plane.

22. The antenna as claimed in claim 1, further comprising a second conductive element connecting the second transmission element and the ground element, wherein the second conductive element is connected to an end of the second transmission element.

23. The antenna as claimed in claim 1, further comprising a second conductive element connecting the second transmission element and the ground element, wherein the second conductive element is connected to a middle portion of the second transmission element.

24. The antenna as claimed in claim 1, further comprising a third conductive element connecting the third transmission element and the ground element, wherein the third conductive element is connected to an end of the third transmission element.

25. The antenna as claimed in claim 1, further comprising a third conductive element connecting the third transmission element and the ground element, wherein the third conductive element is connected to a middle portion of the third transmission element.

26. A portable electronic device, comprising:

a housing; and an antenna disposed in the housing and comprising:

a ground element;

a first transmission element having a at least one coupling portion, a first side and a second side and electrically connected to the ground element;

a feed element, corresponding to the coupling portion, wherein the feed element is separated from the coupling portion;

a second transmission element, corresponding to the first side and electrically connected to the ground element; and a third transmission element, corresponding to the second side and electrically connected to the ground element, wherein when transmitting a first wireless signal, the feed element electrically couples to the first transmission element to transmit the first wireless signal, and when transmitting a second wireless signal, the feed element electrically couples to the first transmission element, and the second transmission element and the third transmission element couple to the first transmission element to transmit the second wireless signal.

27. The portable electronic device as claimed in claim 26, wherein the electronic device is a cell phone.

28. The portable electronic device as claimed in claim 27, wherein the housing comprises a display portion, and the antenna is disposed on a side of the display portion.

29. The portable electronic device as claimed in claim 26, wherein the electronic device is a notebook.

30. The portable electronic device as claimed in claim 29, wherein the housing receives a display device, and the antenna is disposed between the display device and the housing.

* * * * *